United States Patent [19]

Sumino et al.

[11] Patent Number: 4,609,361

[45] Date of Patent: Sep. 2, 1986

[54] FISH LINE AND WEED CUTTER FOR MARINE PROPELLER

[75] Inventors: Yoshitsugu Sumino, Hamana; Hiroichi Mizuno, Hamamatsu, both of Japan

[73] Assignee: Sanshin Kogyo Kabushiki Kaisha, Japan

[21] Appl. No.: 580,150

[22] Filed: Feb. 14, 1984

[30] Foreign Application Priority Data

Feb. 15, 1983 [JP] Japan ..... 58-22132

[51] Int. Cl.[4] ..... B63H 1/28

[52] U.S. Cl. ..... 440/73; 416/146 R

[58] Field of Search ..... 440/76, 78, 71, 73; 416/93 A, 146 R, 146 B

[56] References Cited

U.S. PATENT DOCUMENTS 3,552,145 1/1971 Barton et al. ..... 464/73
3,619,083 11/1971 Witte ..... 416/93 A
3,884,049 5/1975 Pauli ..... 464/73
4,080,099 3/1978 Snyder .
4,180,368 12/1979 Henrich et al. .
4,211,515 7/1980 Henrich et al. .
4,236,872 12/1980 Metcalf .
4,317,655 3/1982 Schiek ..... 416/93 A

*Primary Examiner*—Galen L. Barefoot
*Assistant Examiner*—Thomas J. Brahan
*Attorney, Agent, or Firm*—Ernest A. Beutler

[57] ABSTRACT

A fish line and weed cutting arrangement for a marine propulsion lower unit wherein the cutting member may be formed from sheet metal or the like and is positioned between the propeller and thrust taking member. The propeller is formed with a recess that receives and rotatably couples the fish line and weed cutting member and which does not interfere with the axial positioning of the propeller on the drive shaft.

10 Claims, 3 Drawing Figures

FISH LINE AND WEED CUTTER FOR MARINE PROPELLER

BACKGROUND OF THE INVENTION

This invention relates to a fish line and weed cutter for a marine propeller and more particularly to an improved, simplified and easily replaceable cutter for such an application.

Various devices have been proposed for cutting fish lines or weeds to prevent their entanglement from the area around the drive shaft in the area where it passes through the lower unit. In some instances, these fish line cutters are formed integrally with either the hub or lower unit housings or are made up of integral components with either or both of these parts. Alternatively, the fish line and weed cutter may be a separable unit that is somehow affixed to the propeller or drive shaft assembly. The use of a separate piece for this purpose has the advantage that it does not add to the cost of forming the propeller and lower unit and also that it may afford a component that can be replaced if damaged without high cost. However, the fish line cutter should be rotatable with the propeller and the previously proposed arrangement of this type have been very complicated, considering the relative simplicity of the device, or have had other disadvantages.

It is well known to employ some form of resilient coupling between the hub of the propeller and the drive shaft. These resilient couplings afford some vibration damping. However, the propeller hub and drive shaft should have positive engagement in the axial direction so as to substantially fix the position of the propeller relative to the drive shaft. The previously proposed arrangements embodying separate thrust members have not been effective in permitting this positive engagement without giving rise to variations in the axial positioning of the propeller on the drive shaft depending upon the weed cutting member employed. That is, if the weed cutter is changed, the axial positioning of the propeller on the drive shaft may also change.

It is, therefore, a principal object of this invention to provide an improved and simplified weed cutter for a marine propeller that may be conveniently replaced and yet one which does not affect the axial positioning between the propeller and drive shaft.

It is a further object of this invention to provide a marine propulsion device using a weed cutter that is positioned between the propeller and thrust taking member of the drive shaft and which does not affect the spacing therebetween.

SUMMARY OF THE INVENTION

This invention is adapted to be embodied in a fish line and weed cutter for a marine propulsion device having a lower unit and a drive shaft journalled by the lower unit. The lower unit defines an annular recess that surrounds the drive shaft. A propeller having a hub and at least one blade extending from the hub is affixed to the drive shaft by means that includes a thrust member. In accordance with the invention, the propeller and the thrust member have facing surfaces that are adapted for abutting engagement for transferring thrust forces from the propeller to the thrust member. These surfaces define at least one localized recess where the thrust member is not engaged by the propeller and a fish line and weed cutting member is supported in this recess and has a portion extending in proximity to the lower housing annular recess for cutting fish lines, weeds or the like.

DETAILED DESCRIPTION OF THE PREFERRED EMBODIMENT

Figure 1:
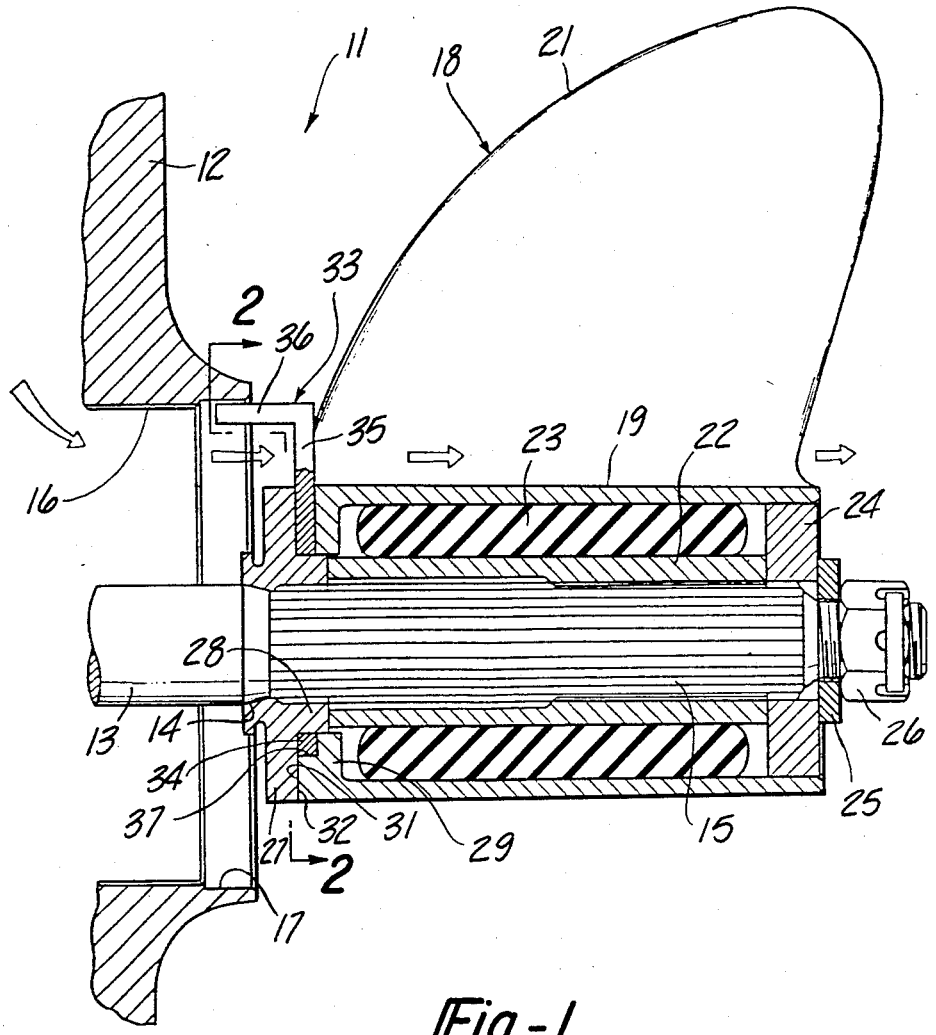
FIG. 1 is a cross-sectional view taken through the lower unit of a marine drive embodying a fish line and weed cutter constructed in accordance with an embodiment of the invention.

In the drawings, the reference numeral 11 indicates generally the relevant portion of the lower unit of a marine propulsion device constructed in accordance with the invention. Inasmuch as the invention relates primarily to the weed and fish line cutting mechanism and its association with the propeller and lower unit, only these components have been illustrated and will be described in detail. The term "lower unit" as used herein and in the claims refers to the lower unit of an outboard motor or the lower unit of the outboard drive portion of an inboard-outboard marine propulsion unit.

The lower unit 11 includes a housing assembly 12 in which a propeller shaft 13 is supported for rotation in any suitable manner. The propeller shaft 13 is driven from either the power unit of the outboard motor or the inboard engine of an inboard-outboard drive in any suitable manner, which may include a forward, neutral, reverse transmission.

The drive shaft 13 is formed with a tapered thrust taking surface 14 adjacent which a rearwardly extending exposed, externally splined portion 15 is provided. The lower unit 12 is provided with an enlarged rearwardly opening cavity 16 which terminates at an annular flange 17 that is concentrically disposed relative to the drive shaft 13. If desired, the passage 16 may be used to discharge exhaust gases beneath the water. The arrows in FIG. 1 show the path of normal exhaust gas discharge in such an application.

A propeller assembly, indicated generally by the reference numeral 18 is provided for driving the watercraft. The propeller 18 includes an outer hub portion 19 from which one or more propeller blades 21 integrally extend. The outer hub portion 19 is resiliently connected to an inner hub portion 22 by means of an elastomeric sleeve 23 which is contained between the hub portions 19 and 22 and is held in place in any suitable manner, as by bonding. The elastomer sleeve 23 is provided so as to afford vibration damping and is generally effective in a torsional or circumferential rather than in an axial direction.

The inner hub 22 is internally splined so as to afford a connection with the drive shaft splines 15 that affixes the hub 22 non-rotatably to the drive shaft 13. The inner hub 22 is fixed axially relative to the drive shaft 13 by an arrangement which includes an annular member 24 positioned at the rear end of the outer hub 19 and which is engaged by a washer 25 and held in place by a nut 26 received on a threaded end of the drive shaft 13 so as to preclude inadvertent rearward disassembly of the propeller 18 from the drive shaft 13.

At the forward ends of the drive splines 13, a thrust taking member or washer 27 is provided that has an inner face which is engaged with the drive shaft thrust taking surface 14. The thrust taking member 27 has a hub portion 28 that is engaged by the inner hub 22 so as to axially fix the thrust taking member 27 and inner hub 22 relative to the drive shaft 13.

The outer hub 19 has, at its forward end, an inwardly extending flange 29 that defines a forwardly facing surface or shoulder 31 that is normally engaged with a rearwardly facing shoulder 32 of the thrust member 27 so as to provide a positive mechanical connection between the propeller 18 and the thrust member 27 for transferring the drive thrust from the propeller 18 to the lower unit.

Figure 2:
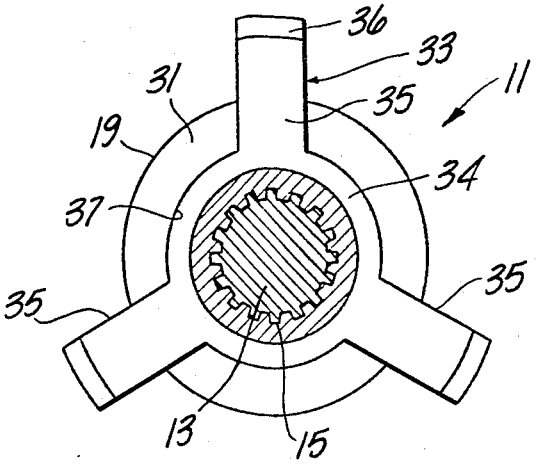
FIG. 2 is a view looking generally in the direction of the line 2—2 of FIG. 1 and shows how the weed cutter is non-rotatably fixed to the propeller.
Figure 3:
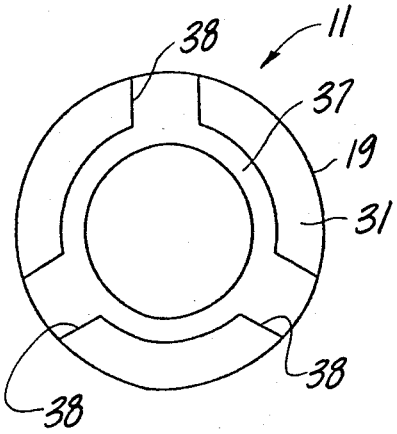
FIG. 3 is a view looking in the same general direction as FIG. 2 with the fish line and weed cutting member removed.

In accordance with the invention, a combined fish line and weed cutting member, indicated generally by the reference numeral 33 is provided which is rotatably coupled with the propeller 18, axially fixed between the propeller 18 and the thrust taking member 27 and which, nevertheless, does not interfere with the axial positioning of the propeller 18 relative to the thrust taking member 27. The fish line and weed cutting member 33 may be conveniently formed from sheet metal or the like and has a configuration which may be best understood by reference to FIG. 2. The member 33 has a generally annular inner surface 34 that is planar and from which a plurality of arms 35 extend in generally the same plane. The center portion 34 and arms 35 are of the same thickness. The outer ends of the arms 35 are forwardly bent, as at 36 and may be generally curved along their outer face. These forwardly projecting arms 36 extend into close proximity to the lower housing recess 17 as shown in FIG. 1 so as to perform their fish line and weed cutting function, as will be described.

A recess is formed between the forward face of the propeller outer hub 19 and specifically its surface 31 and the mating surface 32 of the thrust taking member 27. In the illustrated embodiment, this recess is formed completely in the propeller hub portion 29 and consists of a generally annular section 37 that is complementary to the weed cutter hub portion 34 and a plurality of radially extending recesses 38 which are complementary in number and size to the arms 35. As a result of this configuration, the weed and fish line cutting member 33 will be clamped in the recess consisting of the portion 36 and the arms 38 and held against rotation. However, the positioning of the member 33 in this area will not interfere with the direct thrust engagement between the propeller hub surface 31 and the thrust member surface 32. Therefore, the fish line and weed cutting member 33 is held both axially and circumferentially between these two members but it does not prevent or determine their axial engagement.

If for some reason the weed cutting member 33 is damaged, it may be easily replaced by removing the nut 26, washer 25, member 24 and propeller 18. A new member 33 may be inserted and as long as its width does not exceed the width of the recess portions 37 and 38, the axial position of the propeller 18 on the drive shaft 13 will not be affected.

It should be readily apparent from the foregoing description that this construction provides accurate spacing of the propeller on the drive shaft, convenient replacement of the fish line and weed cutting member and also assures simultaneous rotation of this member with the propeller. Although an embodiment of the invention has been illustrated and described, various changes and modifications may be made without departing from the spirit and scope of the invention, as defined by the appended claims.

We claim:

1. A fish line and weed cutter for a marine propulsion device having a lower unit, a drive shaft journalled by said lower unit, said lower unit defining an annular cavity surrounding said drive shaft, a propeller having a hub and at least one blade extending therefrom, and means including a thrust member for non-rotatably affixing said propeller to said drive shaft, the improvement comprising said propeller and said thrust member having facing surfaces in abutting engagement for transferring thrust forces from said propeller to said thrust member, said surfaces defining at least one localized recess where said thrust member is not engaged by said propeller, and a fish line and weed cutting member supported in said recess and having a portion extending in proximity to said lower unit annular cavity for cutting fish lines and weeds or the like, said recess and said fish line and weed cutting member being configured so as to non-rotatably connect said fish line and weed cutting member to said propeller and so as to maintain the abutting engagement between said facing surfaces of said propeller and said thrust member.

2. A fish line and weed cutter as set forth in claim 1 wherein the recess is comprised of an annular portion from which radially extending portions extend, the fish line and weed cutting member having a hub portion received in said annular cavity and radially extending portions received within said recess radially extending portions.

3. A fish line and weed cutter as set forth in claim 1 wherein the fish line and weed cutting member has a plurality of portions circumferentially spaced from each other and extending in proximity to the lower housing annular cavity for cutting fish lines and weeds.

4. A fish line and weed cutter as set forth in claim 3 wherein the portions of the fish line and weed cutting member all are integrally connected to a common hub portion.

5. A fish line and weed cutter as set forth in claim 4 wherein the recess is formed in a forward surface of the propeller.

6. A fish line and weed cutter as set forth in claim 1 further including elastomeric cushioning means interposed between the propeller blade and the drive shaft.

7. A fish line and weed cutter as set forth in claim 6 wherein the fish line and week cutting member has a plurality of portions circumferentially spaced from each other and extending in proximity to the lower housing annular cavity for cutting fish lines and weeds.

8. A fish line and weed cutter as set forth in claim 7 wherein the portions of the fish line and weed cutting member all are integrally connected to a common hub portion.

9. A fish line and weed cutter as set forth in claim 8 wherein the recess is formed in a forward surface of the propeller.

10. A fish line and weed cutter as set forth in claim 9 wherein the hub and extending portions all have the same thickness, the extending portions terminating in outer ends that are bent forwardly and which enter into the lower housing annular cavity.

* * * * *